US010693205B2

(12) United States Patent
Yoshikawa et al.

(10) Patent No.: US 10,693,205 B2
(45) Date of Patent: Jun. 23, 2020

(54) RESONATOR, FILTER, AND COMMUNICATION DEVICE

(71) Applicant: KYOCERA Corporation, Kyoto-shi, Kyoto (JP)

(72) Inventors: Hiromichi Yoshikawa, Kyoto (JP); Masafumi Horiuchi, Kyoto (JP); Katsuro Nakamata, Kyoto (JP)

(73) Assignee: KYOCERA CORPORATION, Kyoto (JP)

( * ) Notice: Subject to any disclaimer, the term of this patent is extended or adjusted under 35 U.S.C. 154(b) by 257 days.

(21) Appl. No.: 15/513,651

(22) PCT Filed: Sep. 16, 2015

(86) PCT No.: PCT/JP2015/076316

§ 371 (c)(1),
(2) Date: Mar. 23, 2017

(87) PCT Pub. No.: WO2016/047531

PCT Pub. Date: Mar. 31, 2016

(65) Prior Publication Data

US 2017/0309982 A1 Oct. 26, 2017

(30) Foreign Application Priority Data

Sep. 24, 2014 (JP) ..... 2014-193941
Oct. 30, 2014 (JP) ..... 2014-221563
Feb. 24, 2015 (JP) ..... 2015-034135

(51) Int. Cl.
*H01P 1/20* (2006.01)
*H01P 7/10* (2006.01)
(Continued)

(52) U.S. Cl.
CPC ..... *H01P 1/2002* (2013.01); *H01P 1/2053* (2013.01); *H01P 1/2084* (2013.01); *H01P 7/04* (2013.01); *H01P 7/10* (2013.01)

(58) Field of Classification Search
CPC ..... H01Q 1/20; H01Q 1/241; H01Q 9/0407; H01Q 1/3275; H01Q 1/3283; H01Q 1/325
(Continued)

(56) References Cited

U.S. PATENT DOCUMENTS 5,859,574 A * 1/1999 Schmitt ..... H01P 7/10 333/202
6,211,755 B1 * 4/2001 Kubota ..... H01P 7/10 333/219.1
(Continued)

FOREIGN PATENT DOCUMENTS

JP 55-141802 A 11/1980
JP 63-159904 U1 10/1988
(Continued)

OTHER PUBLICATIONS

Japanese Office Action with English concise explanation, Japanese Patent Application No. 2016-550136, dated Sep. 12, 2017, 4 pgs.
(Continued)

*Primary Examiner* — Andrea Lindgren Baltzell
(74) *Attorney, Agent, or Firm* — Volpe and Koenig, P.C.

(57) ABSTRACT

A resonator includes a shield conductor, a columnar body, and a first dielectric body. The shield conductor includes a first conductor located on a negative z-direction side and a second conductor located on a positive z-direction side, and has a cavity therein. The columnar body has a columnar shape, and is placed inside the cavity, an end in the negative z-direction thereof being joined to the first conductor, an interval being provided between an end in the positive z-direction of the columnar body and the shield conductor. The first dielectric body is placed inside the cavity, an end in the positive z-direction thereof being joined to the second conductor, an interval being provided between an end in the negative z-direction of the first dielectric body and the shield conductor, the first dielectric body surrounding the columnar body so as to be apart from each other.

10 Claims, 14 Drawing Sheets

(51) Int. Cl.
*H01P 7/04* (2006.01)
*H01P 1/208* (2006.01)
*H01P 1/205* (2006.01)

(58) Field of Classification Search
USPC ..... 343/904, 711, 757, 720
See application file for complete search history.

(56) References Cited

U.S. PATENT DOCUMENTS

| | | | | |
|---|---|---|---|---|
| 6,356,171 | B2 * | 3/2002 | Fiedziuszko | H01P 1/2086 333/212 |
| 2011/0121917 | A1 * | 5/2011 | Blair | H01P 1/2053 333/203 |
| 2013/0196608 | A1 * | 8/2013 | Yoshikawa | H01P 1/2053 455/73 |
| 2014/0204548 | A1 * | 7/2014 | Sekine | H05K 1/162 361/761 |

FOREIGN PATENT DOCUMENTS

| | | | |
|---|---|---|---|
| JP | 2011-035792 | A | 2/2011 |
| JP | 2014-120922 | A | 6/2014 |
| JP | 5550733 | B2 | 7/2014 |
| WO | 2009/073934 | A1 | 6/2009 |
| WO | 2012/043739 | A1 | 4/2012 |

OTHER PUBLICATIONS

International Search Report, PCT/JP2015/076316, dated Nov. 10, 2015, 1 pg.

* cited by examiner

RESONATOR, FILTER, AND COMMUNICATION DEVICE

TECHNICAL FIELD

The present invention relates to a resonator, and a filter and a communication device that employ the resonator.

BACKGROUND ART

There is known a resonator in which a columnar conductor connected to ground at one end thereof is accommodated in a shield case (refer to Patent Literature 1, for example). There is also known a resonator in which a columnar dielectric body is accommodated in a shield case (refer to Patent Literature 2, for example).

CITATION LIST

Patent Literature

Patent Literature 1: Japanese Unexamined Patent Publication JP-A 2011-35792

Patent Literature 2: Japanese Unexamined Utility model Publication JP-U 63-159904 (1988)

SUMMARY OF INVENTION

Technical Problem

However, the conventional resonators as described in Patent Literatures 1 and 2 present the problem of deterioration in electrical characteristics that is entailed by miniaturization.

The invention has been devised in view of the problem associated with the conventional art as discussed supra, and accordingly an object of the invention is to provide a compact resonator having excellent electrical characteristics, and a filter and a communication device that employ the resonator.

Solution to Problem

A resonator in accordance with one embodiment of the invention comprises: a shield conductor including a first conductor located on a side of a first direction and a second conductor located on a side of a second direction opposite to the side of the first direction, the shield conductor having a cavity therein; a columnar body which is composed of a dielectric body or conductor and has a columnar shape, the columnar body being placed inside the cavity, an end in the first direction of the columnar body being joined to the first conductor, an interval being provided between an end in the second direction of the columnar body and the shield conductor; and at least one first dielectric body placed inside the cavity, one end in the second direction of the at least one first dielectric body being joined to the second conductor, an interval being provided between one end in the first direction of the at least one first dielectric body and the shield conductor, the at least one first dielectric body surrounding the columnar body so as to be apart from each other.

A filter in accordance with one embodiment of the invention comprises: a plurality of resonators which are each structurally identical with the above-described resonator, the plurality of resonators being disposed in an array so as to be electromagnetically coupled to each other, the plurality of resonators including a first resonator located at one end of the array and a second resonator located at the other end of the array; a first terminal electrode electrically or electromagnetically connected to the first resonator; and a second terminal electrode electrically or electromagnetically connected to the second resonator.

A communication device in accordance with one embodiment of the invention comprises: an antenna; a communication circuit; and the above-mentioned filter connected to the antenna and the communication circuit.

Advantageous Effects of Invention

According to one embodiment of the invention, there is provided a compact resonator having excellent electrical characteristics. According to one embodiment of the invention, there is provided a compact filter having excellent electrical characteristics. According to one embodiment of the invention, there is provided a compact communication device of high communication quality.

DESCRIPTION OF EMBODIMENTS

Figure 1:
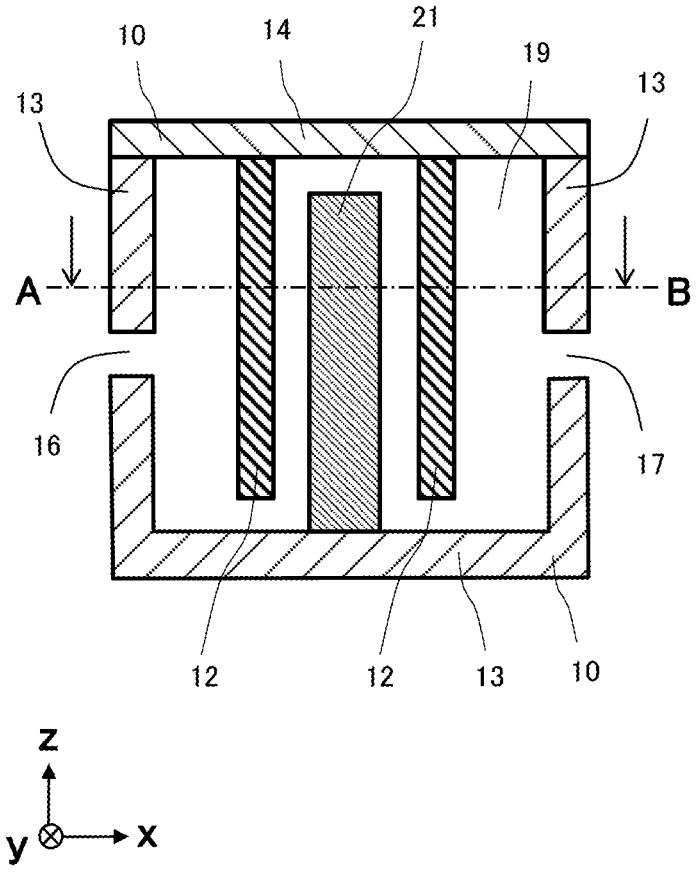
FIG. 1 is a sectional view schematically showing a resonator in accordance with a first embodiment of the invention.

Hereinafter, a resonator pursuant to the invention, and a filter and a communication device that employ the resonator will be described in detail with reference to the accompanying drawings. In the drawings, directions are indicated by mutually perpendicular x axis, y axis, and z axis.

First Embodiment

Figure 2:
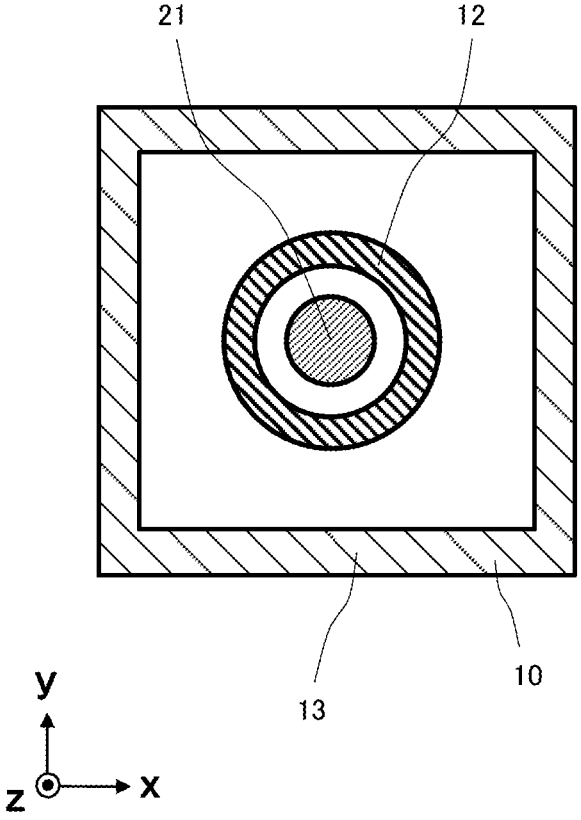
FIG. 2 is a sectional view of the resonator taken along the line A-B shown in FIG. 1.
Figure 3:
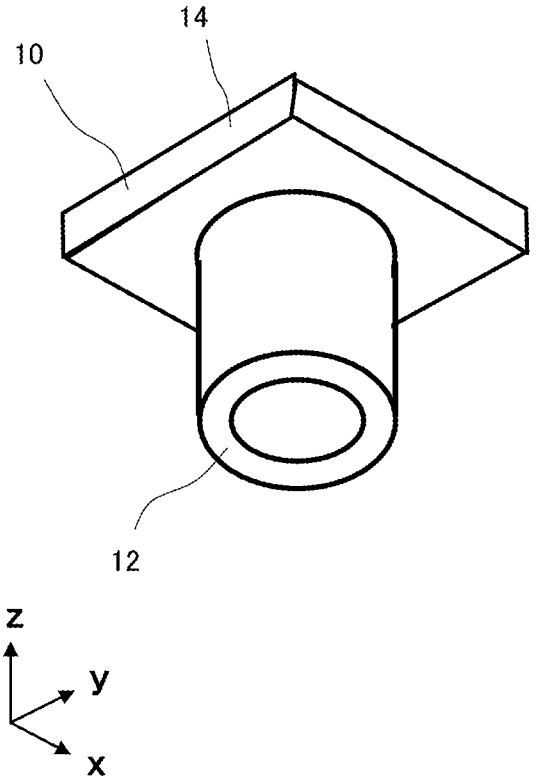
FIG. 3 is a perspective view schematically showing part of the constituent components of the resonator in accordance with the first embodiment of the invention.
Figure 4:
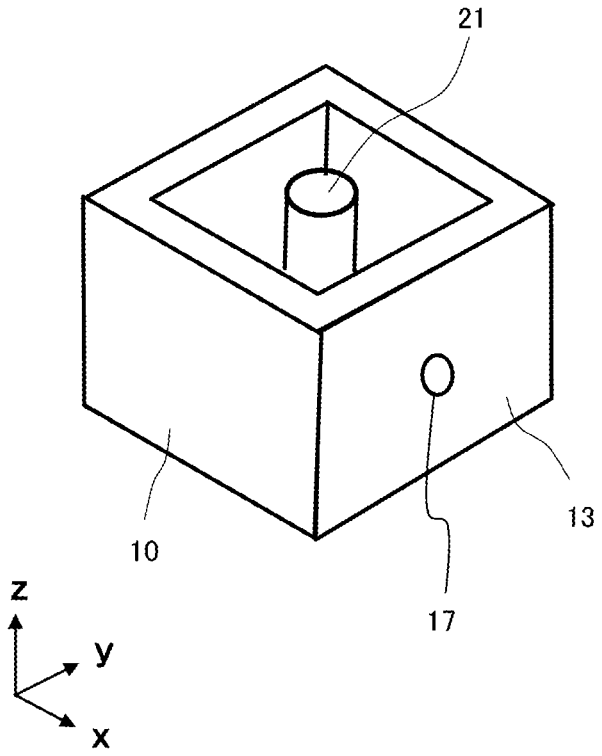
FIG. 4 is a perspective view schematically showing another constituent component of the resonator in accordance with the first embodiment of the invention.

FIG. 1 is a sectional view schematically showing a resonator in accordance with a first embodiment of the invention. FIG. 2 is a sectional view of the resonator taken along the line A-B shown in FIG. 1. FIGS. 3 and 4 are perspective views schematically showing part of the constituent components of the resonator in accordance with the first embodiment of the invention. As shown in FIGS. 1 to 4, the resonator of this embodiment comprises a shield conductor 10, a columnar body 21, and a first dielectric body 12. The shield conductor 10 comprises a first conductor 13 and a second conductor 14.

The shield conductor 10, which is shaped in a rectangular parallelepiped box having a cavity 19 therein, is connected at a reference potential (called ground potential or earth potential). Moreover, the shield conductor 10 comprises the first conductor located on a negative z-direction side, and the second conductor 14 located on a positive z-direction side, the first conductor 13 and the second conductor 14 being joined to each other by a non-illustrated electrically-conductive joining member. The first conductor 13 is shaped in a rectangular parallelepiped box opened toward the positive z-direction side. The second conductor 14 is shaped in a rectangular flat plate. Moreover, the first conductor 13 is provided with a through hole 16 and a through hole 17. The through hole 16 and the through hole 17 are used for connection with an external circuit.

The first conductor 13 and the second conductor 14 may be made of heretofore known various electrically-conductive materials such as metals or non-metallic conductive materials. In the interest of improving the characteristics of the resonator, it is desirable to use, for example, a conductive material predominantly composed of Ag or an alloy of Ag such as a Ag—Pd alloy or a Ag—Pt alloy, a Cu-based conductive material, a W-based conductive material, a Mo-based conductive material, or a Pd-based conductive material.

As the conductive joining member for joining the first conductor 13 and the second conductor 14 together, heretofore known various conductive joining members such as solder or conductive adhesives can be used. In some cases, the first conductor 13 and the second conductor 14 may be joined to each other via a screw or a bolt. Moreover, while the cavity 19 is filled with air, a vacuum may be created therein, or, the cavity 19 may be filled with other gaseous substance than air.

The columnar body 21 is located in a center of the cavity 19, and is shaped in a cylinder extending in a positive z-direction. Moreover, the columnar body 21 is joined to the first conductor 13 at its end in the negative z-direction by a non-illustrated conductive joining member. A clearance is left between an end in the positive z-direction of the columnar body and the shield conductor 10. That is, the surface in the negative z-direction of the columnar body 21 is entirely bonded to the first conductor 13, and, there is a clearance between the surface in the positive z-direction of the columnar body 21 and the shield conductor 10 (the second conductor 14).

In this embodiment, the columnar body 21 is made of a conductor, and the resonator of this embodiment serves as a resonator having a resonant mode analogous to TEM mode. Note that the columnar body 21 may be made of a dielectric body. In this case, the resonator serves as a resonator having a resonant mode analogous to TM mode.

The columnar body 21 of this embodiment may be made of heretofore known various conductive materials such as metals or non-metallic conductive materials. In the interest of improving the characteristics of the resonator, it is desirable to use, for example, a conductive material predominantly composed of Ag or an alloy of Ag such as a Ag—Pd alloy or a Ag—Pt alloy, a Cu-based conductive material, a W-based conductive material, a Mo-based conductive material, or a Pd-based conductive material.

The first dielectric body 12 is located in the center of the cavity 19, and is shaped in a cylinder extending in the positive z-direction. The columnar body 21 is located in a center of the interior of the first dielectric body 12. That is, the first dielectric body 12 surrounds the columnar body 21 so as to be apart from each other. Moreover, the first dielectric body is joined to the second conductor 14 at its end in the positive z-direction by a non-illustrated conductive joining member. A clearance is left between an end in the negative z-direction of the first dielectric body 12 and the shield conductor 10. That is, the surface in the positive z-direction of the first dielectric body 12 is entirely bonded to the second conductor 14, and, there is a clearance between the surface in the negative z-direction of the first dielectric body 12 and the shield conductor 10 (the first conductor 13).

The length of the columnar body 21 in the positive z-direction is preferably greater than or equal to 80% of the dimension of the cavity 19 in the positive z-direction, or more preferably greater than or equal to 90% of the dimension of the cavity 19 in the positive z-direction. Moreover, it is preferable that more than one-half the total part of the columnar body 21 in the positive z-direction is surrounded by the first dielectric body 12. The ratio of the length of a part of the columnar body 21 which is surrounded by the first dielectric body 12 in the positive z-direction to the total length of the columnar body 21 in the positive z-direction is preferably greater than or equal to 50%, or more preferably greater than or equal to 80%, or still more preferably greater than or equal to 90%. The dimensions of the cavity 19, the diameter of the columnar body 21, the distance between the columnar body 21 and the first dielectric body 12, and the thickness of the first dielectric body 12 are suitably determined in conformity with the desired size, the resonant frequency of resonance in a fundamental mode, and the resonant frequency of resonance in a higher-order mode.

As the material of the first dielectric body 12, a heretofore known dielectric material such as dielectric ceramics may be used. For example, a dielectric ceramic material containing $BaTiO_3$, $Pb_4Fe_2Nb_2O_{12}$ $TiO_2$ or the like can be preferably used. In some cases, a resin such as epoxy resin may be used.

As the conductive joining member for joining the first dielectric body 12 and the shield conductor 10 together, heretofore known various conductive joining members such for example as conductive adhesives can be used. Moreover, for example, the first dielectric body 12 may be provided with a conductor film which is to be joined to the shield conductor 10 via solder or the like. In this case, the conductor film and the solder serve as the conductive joining member.

Thus, the resonator of this embodiment comprises the shield conductor 10, the columnar body 21, and the first dielectric body 12. The shield conductor 10 includes the first conductor 13 located on the negative z-direction side and the second conductor 14 located on the positive z-direction side opposite the negative z-direction side, and has the cavity 19 therein. The columnar body 21 is composed of a conductor, has a columnar shape, is placed inside the cavity 19, is joined to the first conductor 13 at its end in the negative z-direction, and has its end in the positive z-direction positioned apart from the shield conductor 10. The first dielectric body 12 is placed inside the cavity 19, is joined to the second conductor 14 at its end in the positive z-direction, has its end in the negative z-direction positioned apart from the shield conductor 10, and surrounds the columnar body 21 so as to be apart from each other. The resonator thus configured of this embodiment serves as a resonator having a resonant mode analogous to TEM mode.

Difficulties have been experienced in miniaturizing the conventional resonator as described in Patent Literature 1. For cases where miniaturization is achieved by filling the interior of the shield case with a dielectric body, the resonant frequency of resonance in a higher-order mode is sharply decreased to a level proximate to the resonant frequency of resonance in a fundamental mode, with consequent deterioration in electrical characteristics. Also, for cases where miniaturization is achieved by placing a dielectric body between the open end of the columnar conductor and the shield case, there arises a sharp decrease in Q, with consequent deterioration in electrical characteristics.

The resonator of this embodiment thus configured is made smaller in size than the resonator described in Patent Literature 1, suppresses a decrease in the resonant frequency of higher-order mode resonance as contrasted to the resonator described in Patent Literature 1 in which the interior of the shield case is filled with the dielectric body, and suppresses a decrease in Q as contrasted to the resonator described in Patent Literature 1 in which the dielectric body is placed between the open end of the columnar conductor and the shield case. That is, the resonator of this embodiment has excellent electrical characteristics involving an appreciable difference between the resonant frequency of fundamental-mode resonance and the resonant frequency of higher-order mode resonance, and a high Q, yet features small size. That is, the resonator of this embodiment is compact, yet excels in electrical characteristics.

Moreover, for example, the resonator thus configured of this embodiment may also be produced by making a structure as shown in FIG. 4 by joining the end in the negative z-direction of the columnar body 21 to the first conductor 13, making a structure as shown in FIG. 3 by joining the end in the positive z-direction of the first dielectric body 12 to the second conductor 14, and joining the first conductor 13 and the second conductor 14 together so that the columnar body 21 is situated inside the first dielectric body 12. This enables easy manufacture of a highly reliable resonator in which the end in the negative z-direction of the columnar body 21 is securely joined to the first conductor 13, and the end in the positive z-direction of the first dielectric body 12 is securely joined to the second conductor 14.

Moreover, in the resonator of this embodiment, the first dielectric body 12 is cylindrically shaped. Thus, it is possible to surround the columnar body 21 by a single first dielectric body 12 of simple form so as to be apart from each other, wherefore the resonator lends itself readily to mass production.

Second Embodiment

Figure 5:
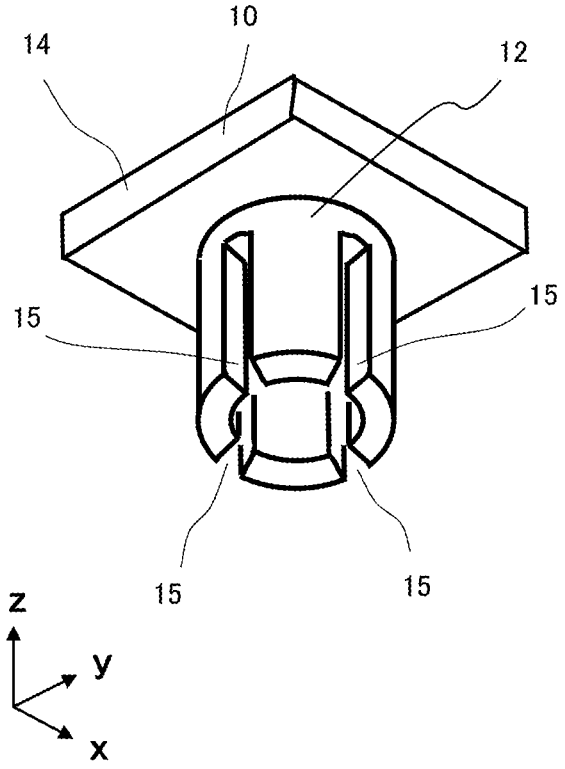
FIG. 5 is a perspective view schematically showing part of the constituent components of a resonator in accordance with a second embodiment of the invention.

FIG. 5 is, like FIG. 3, a perspective view schematically showing part of the constituent components of the resonator in accordance with a second embodiment of the invention. The following description of this embodiment deals only with the points of difference from the foregoing first embodiment, and like constituent components will be identified with the same reference symbols and overlapping descriptions will be omitted.

As shown in FIG. 5, the resonator of this embodiment differs from the resonator of the first embodiment in the configuration of the first dielectric body 12, and is otherwise identical with the resonator of the first embodiment. In the resonator of this embodiment, the first dielectric body 12 is provided with a plurality of slits 15. Each slit 15 is formed so as to extend from the end in the negative z-direction of the first dielectric body 12 toward the end in the positive z-direction thereof. By virtue of the plurality of slits 15, the resonator of this embodiment is capable of further suppressing a decrease in the resonant frequency of resonance in a higher-order mode.

While the shape and number of the slits 15 may be suitably determined in accordance with the desired electrical characteristics, the slit 15 is preferably elongated in the lengthwise direction (the positive z-direction) of the first dielectric body 12. Moreover, the ratio of the dimension of the slit 15 in the positive z-direction to the dimension of the first dielectric body 12 in the positive z-direction is preferably greater than or equal to 60%, or more preferably greater than or equal to 80%.

Third Embodiment

Figure 6:
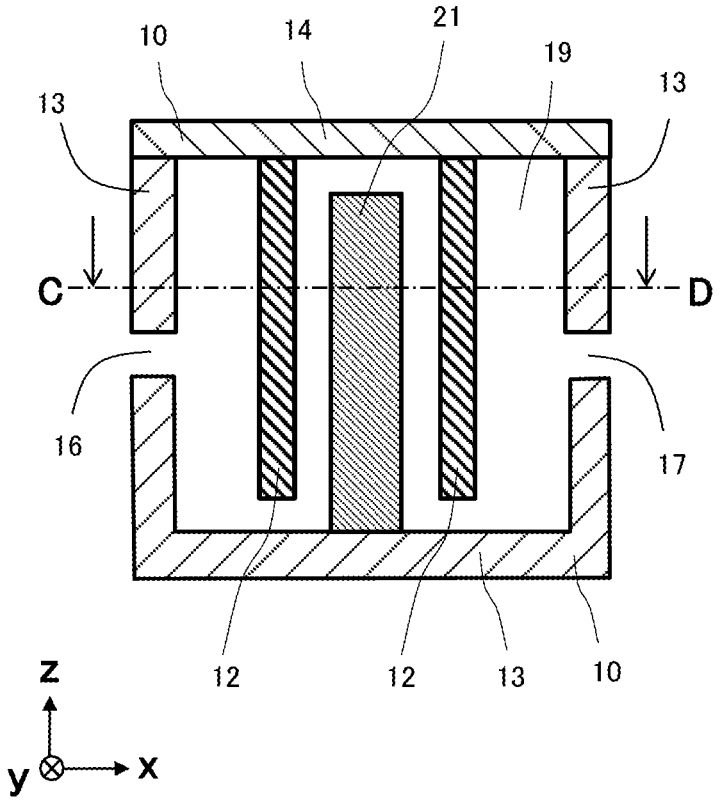
FIG. 6 is a sectional view schematically showing a resonator in accordance with a third embodiment of the invention.
Figure 7:
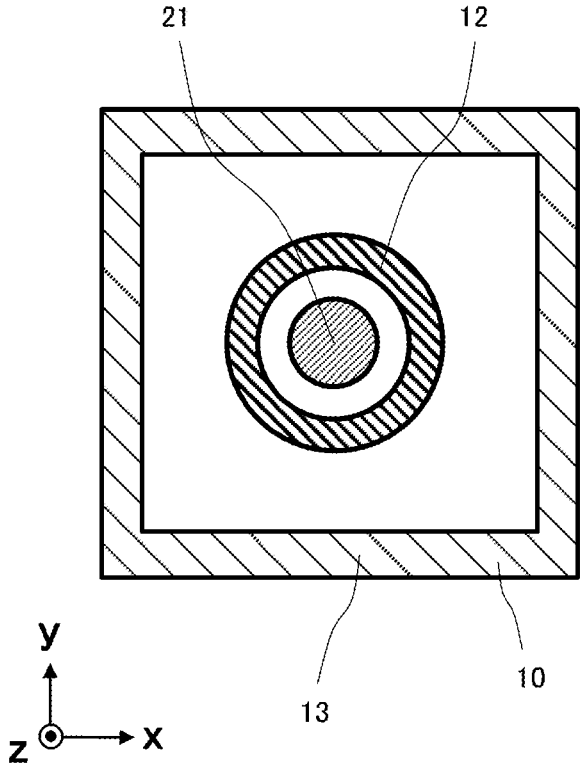
FIG. 7 is a sectional view of the resonator taken along the line C-D shown in FIG. 6.
Figure 8:
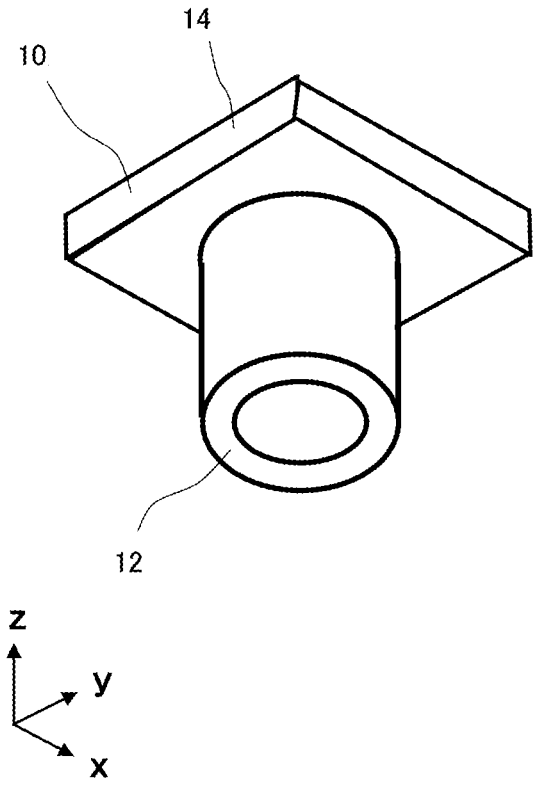
FIG. 8 is a perspective view schematically showing part of the constituent components of the resonator in accordance with the third embodiment of the invention.
Figure 9:
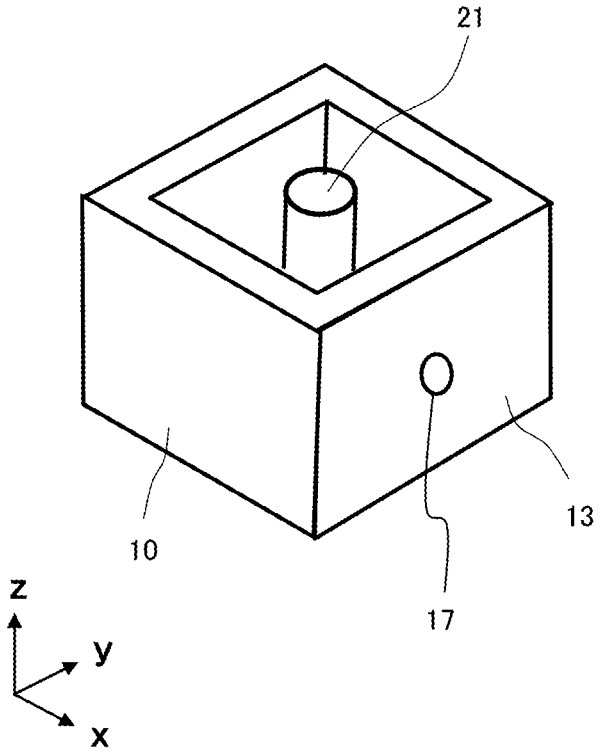
FIG. 9 is a perspective view schematically showing another constituent component of the resonator in accordance with the third embodiment of the invention.

FIG. 6 is a sectional view schematically showing the resonator in accordance with a third embodiment of the invention. FIG. 7 is a sectional view of the resonator taken along the line C-D shown in FIG. 6. FIGS. 8 and 9 are perspective views schematically showing part of the constituent components of the resonator in accordance with the third embodiment of the invention. The following description of this embodiment deals only with the points of difference from the foregoing first embodiment, and like constituent components will be identified with the same reference symbols and overlapping descriptions will be omitted.

In this embodiment, the columnar body 21 is composed of a dielectric body. Otherwise, this embodiment is structurally identical with the foregoing first embodiment.

As the material of the columnar body 21, a heretofore known dielectric material such as dielectric ceramics may be used. For example, a dielectric ceramic material containing $BaTiO_3$, $Pb_4Fe_2Nb_2O_{12}$ $TiO_2$ or the like can be preferably used. In some cases, a resin such as epoxy resin may be used.

The resonator thus configured of this embodiment serves as a resonator having a resonant mode analogous to TM mode because the columnar body 21 is made of a dielectric body. That is, the resonator operates substantially in the same manner as a TM-mode resonator.

In a conventional TM-mode resonator as described in Patent Literature 2, a decrease in resonant frequency will arise in the presence of a clearance between each end face of a columnar dielectric body and the inner surface of a shield case, wherefore both end faces of the columnar dielectric body need to be tightly bonded to the inner surface of the hermetically-sealed shield case. This has led to difficulties in the making of resonators, difficulties in the checking of bonding conditions, and difficulties in high-yield manufacture. Furthermore, for cases where the resonator is designed so that only one of the end faces of the columnar dielectric body is bonded to the shield case to facilitate manufacturing operation, an increase in the volume of the columnar dielectric body has to be made for a decrease in resonant frequency. In this case, however, in addition to the problem of an increase in resonator size, the resonant frequency of resonance in a higher-order mode is decreased to a level proximate to the resonant frequency of resonance in a fundamental mode, with consequent deterioration in electrical characteristics.

Since the resonator thus configured of this embodiment comprises the first dielectric body 12 which surrounds the columnar body 21 so as to be apart from each other, the resonator of this embodiment is capable of decreasing the resonant frequency of fundamental-mode resonance, while keeping a decrease in the resonant frequency of higher-order mode resonance low.

Moreover, the resonator thus configured of this embodiment can be produced by, for example, joining the end in the negative z-direction of the columnar body 21 to the first conductor 13, joining the end in the positive z-direction of the first dielectric body 12 to the second conductor 14, and joining the first conductor 13 and the second conductor 14 together. This enables high-yield and easy production of a resonator in which the end in the negative z-direction of the columnar body 21 is securely joined to the first conductor 13, and the end in the positive z-direction of the first dielectric body 12 is securely joined to the second conductor 14.

Moreover, in the resonator of this embodiment, the first dielectric body 12 has a cylindrical shape. Thus, it is possible to surround the columnar body 21 by a single first dielectric body 12 of simple form so as to be apart from each other, wherefore the resonator lends itself readily to mass production.

Fourth Embodiment

Figure 10:
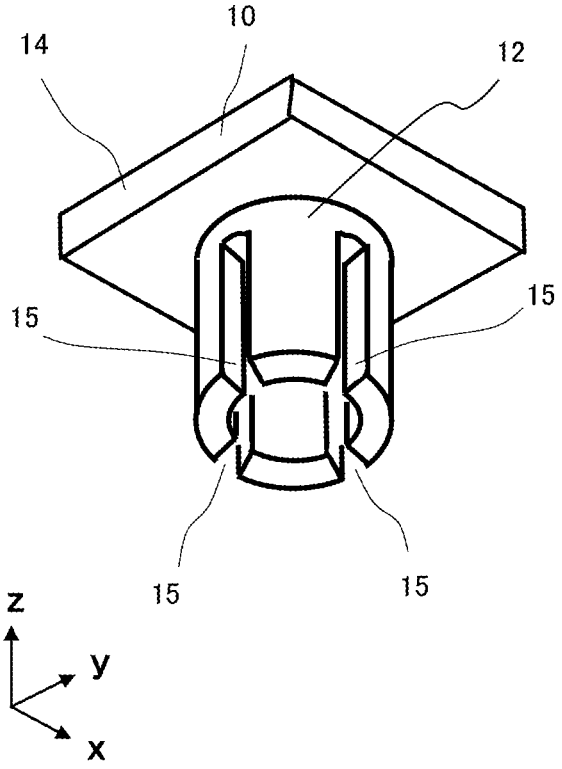
FIG. 10 is a perspective view schematically showing part of the constituent components of a resonator in accordance with a fourth embodiment of the invention.

FIG. 10 is, like FIG. 8, a perspective view schematically showing part of the constituent components of the resonator in accordance with a fourth embodiment of the invention. The following description of this embodiment deals only with the points of difference from the foregoing third embodiment, and like constituent components will be identified with the same reference symbols and overlapping descriptions will be omitted.

As shown in FIG. 10, the resonator of this embodiment differs from the resonator of the third embodiment in the configuration of the first dielectric body 12, and is otherwise identical with the resonator of the third embodiment. In the resonator of this embodiment, the first dielectric body 12 is provided with a plurality of slits 15. Each slit 15 is formed so as to extend from the end in the negative z-direction of the first dielectric body 12 toward the end in the positive z-direction thereof. By virtue of the plurality of slits 15, the resonator of this embodiment is capable of further suppressing a decrease in the resonant frequency of resonance in a higher-order mode.

While the shape and number of the slits 15 may be suitably determined in accordance with the desired electrical characteristics, the slit 15 is preferably elongated in the lengthwise direction (the positive z-direction) of the first dielectric body 12. Moreover, the ratio of the dimension of the slit 15 in the positive z-direction to the dimension of the first dielectric body 12 in the positive z-direction is preferably greater than or equal to 60%, or more preferably greater than or equal to 80%.

Fifth Embodiment

Figure 11:
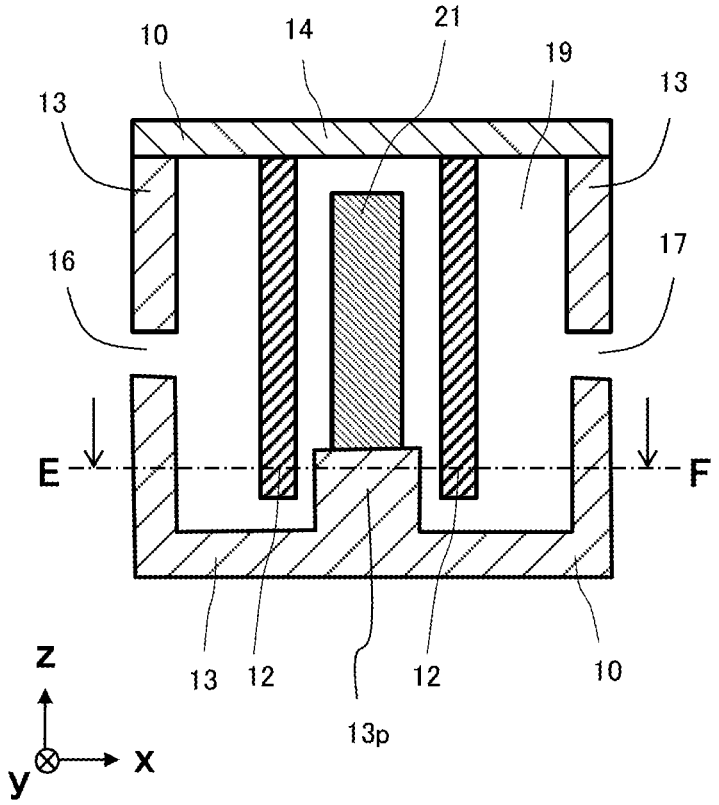
FIG. 11 is a sectional view schematically showing a resonator in accordance with a fifth embodiment of the invention.
Figure 12:
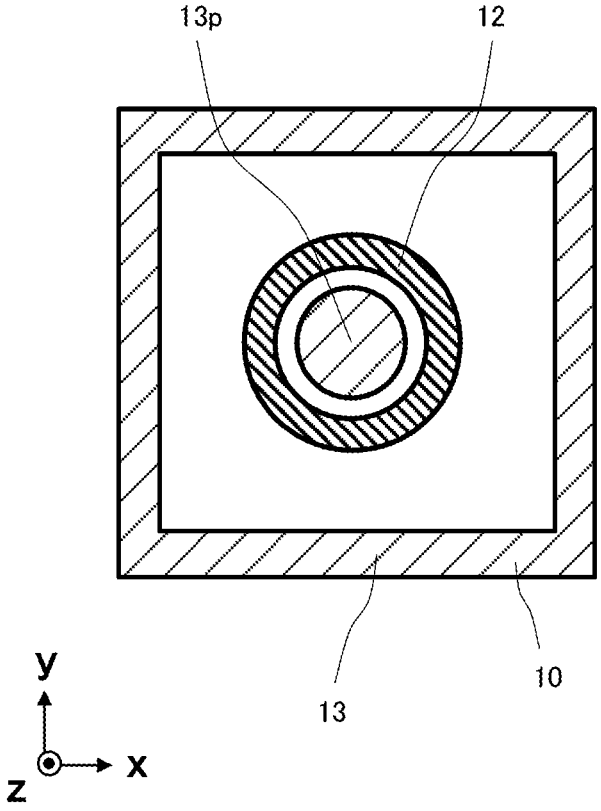
FIG. 12 is a sectional view of the resonator taken along the line E-F shown in FIG. 11.

FIG. 11 is a sectional view schematically showing the resonator in accordance with a fifth embodiment of the invention. FIG. 12 is a sectional view of the resonator taken along the line E-F shown in FIG. 11. The following description of this embodiment deals only with the points of difference from the foregoing third embodiment, and like constituent components will be identified with the same reference symbols and overlapping descriptions will be omitted.

In the resonator of this embodiment, as shown in FIGS. 11 and 12, the first conductor 13 has a projection 13*p*. The projection 13*p* protrudes in the positive z-direction, and, the end in the negative z-direction of the columnar body 21 is joined to an end in the positive z-direction of the projection 13*p*. The length of the columnar body 21 is reduced by an amount equivalent to the length of the projection 13*p* in the positive z-direction. Otherwise, this embodiment is structurally identical with the foregoing third embodiment.

The end in the positive z-direction of the projection 13*p* is located on the positive z-direction side beyond the position of the end in the negative z-direction of the first dielectric body 12. That is, the end in the positive z-direction of the projection 13*p* is situated inside the first dielectric body 12. Thus, the entire columnar body 21 is situated inside the first dielectric body 12.

That is, in the resonator of this embodiment, the first conductor 13 has the projection 13*p* protruding in the positive z-direction, and the end in the positive z-direction of the projection 13*p* is located on the positive z-direction side beyond the position of the end in the negative z-direction of the first dielectric body 12. Moreover, the end in the negative z-direction of the columnar body 21 is joined to the end in the positive z-direction of the projection 13*p*. In this construction, as contrasted to the resonator of the third embodiment, it is possible to decrease the resonant frequency of fundamental-mode resonance, while keeping a decrease in unloaded Q low, and, with equalization of resonant frequency of fundamental-mode resonance, further miniaturization can be achieved. The attainment of such an advantageous effect is presumed to be due to the arrangement of the first dielectric body 12 so as to surround the entire columnar body 21 and a phenomenon in which the intensity of a magnetic field is increased around the projection 13*p*.

The planar configuration of the projection 13*p* (the shape of the projection 13*p* as seen in a plan view in the positive z-direction) may be arbitrarily determined so long as the projection 13*p* is small enough to stay inside the first dielectric body 12. It is also to be noted that losses in the resonator can be reduced to a minimum when designing the projection 13*p* to have the same planar configuration as the planar configuration of the columnar body 21 (the shape of the columnar body 21 as seen in a plan view in the positive z-direction).

Sixth Embodiment

Figure 13:
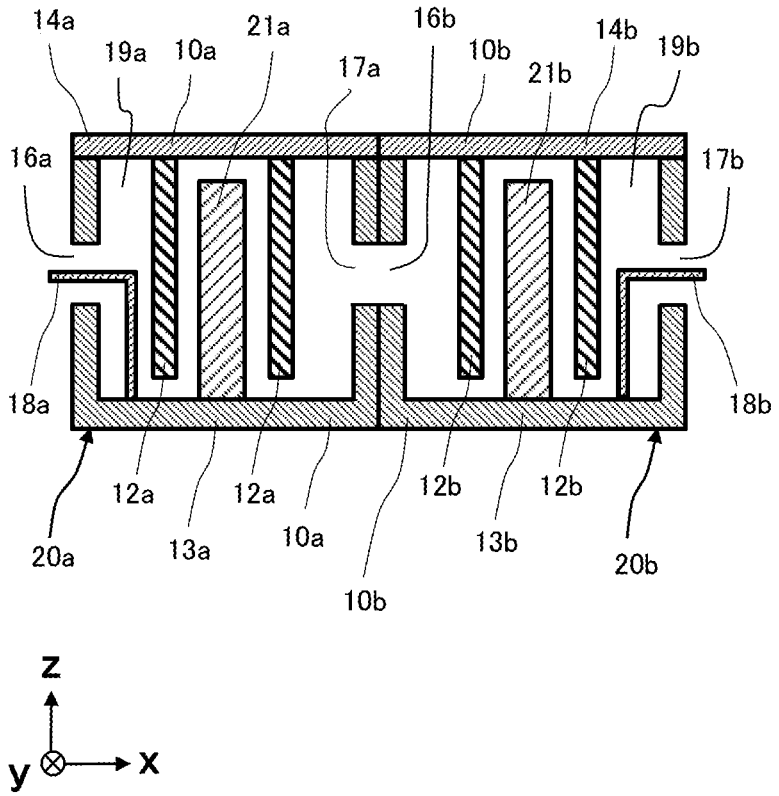
FIG. 13 is a sectional view schematically showing a filter in accordance with a sixth embodiment of the invention.

FIG. 13 is a sectional view schematically showing a filter in accordance with a sixth embodiment of the invention. The following description of this embodiment deals only with the points of difference from the foregoing first embodiment, and like constituent components will be identified with the same reference symbols and overlapping descriptions will be omitted.

The filter of this embodiment comprises a first resonator 20*a*, a second resonator 20*b*, a first terminal electrode 18*a*, and a second terminal electrode 18*b*. The first resonator 20*a* comprises a columnar body 21*a*, a first dielectric body 12*a*, and a shield conductor 10*a*. The shield conductor 10*a* has a cavity 19*a* therein, and comprises a first conductor 13*a* and a second conductor 14*a*. The first conductor 13*a* is provided with a through hole 16*a* and a through hole 17*a*. Moreover, the shield conductor 10*a* is connected at a reference potential (called ground potential or earth potential). The second resonator 20*b* comprises a columnar body 21*b*, a first dielectric body 12*b*, and a shield conductor 10*b*. The shield conductor 10*b* has a cavity 19*b* therein, and comprises a first conductor 13*b* and a second conductor 14*b*. The first conductor 13*b* is provided with a through hole 16*b* and a through hole 17*b*. Moreover, the shield conductor 10*b* is connected at a reference potential (called ground potential or earth potential).

The columnar body 21*a* and the columnar body 21*b* are identical with the columnar body 21 of the first embodiment. The first dielectric body 12*a* and the first dielectric body 12*b* are identical with the first dielectric body 12 of the first embodiment. The first conductor 13*a* and the first conductor 13*b* are identical with the first conductor 13 of the first embodiment. The second conductor 14*a* and the second conductor 14*b* are identical with the second conductor 14 of the first embodiment. The cavity 19*a* and the cavity 19*b* are identical with the cavity 19 of the first embodiment. Moreover, the through hole 16*a* and the through hole 16*b* are identical with the through hole 16 of the first embodiment, and the through hole 17*a* and the through hole 17*b* are identical with the through hole 17 of the first embodiment. That is, the first resonator 20*a* and the second resonator 20*b* are identical with the resonator of the first embodiment.

The first resonator 20*a* and the second resonator 20*b* are disposed side by side so as to form an array. Moreover, the first conductor 13*a* and the first conductor 13*b* are joined to each other by a conductive joining member, and the second conductor 14*a* and the second conductor 14*b* are joined to each other by a conductive joining member. The first resonator 20*a* and the second resonator 20*b* are disposed so that the through hole 17*a* and the through hole 16*b* communicate with each other, and are thus electromagnetically coupled to each other through the through hole 17*a* and the through hole 16*b*.

The first terminal electrode 18*a* is a rod-like member bent in the L shape, and is inserted, through the through hole 16*a*, into the cavity 19*a* of the first resonator 20*a*. One end of the first terminal electrode 18*a* lies outside of the first resonator 20*a*, whereas the other end of the first terminal electrode 18*a* is joined to the first conductor 13*a* within the cavity 19*a*. Moreover, the first terminal electrode 18*a* has a portion extending in the positive z-direction so as to be electromagnetically connected (electromagnetically coupled) to the first resonator 20*a*.

The second terminal electrode 18*b* is a rod-like member bent in the L shape, and is inserted, through the through hole 17*b*, into the cavity 19*b* of the second resonator 20*b*. One end of the second terminal electrode 18*b* lies outside of the second resonator 20*b*, whereas the other end of the second terminal electrode 18*b* is joined to the first conductor 13*b* within the cavity 19*b*. Moreover, the second terminal electrode 18*b* has a portion extending in the positive z-direction so as to be electromagnetically connected (electromagnetically coupled) to the second resonator 20*b*.

The first terminal electrode 18*a* and the second terminal electrode 18*b* may be made of heretofore known various conductive materials such as metals or non-metallic conductive materials. In the interest of improving the characteristics of the filter, it is desirable to use, for example, a conductive material predominantly composed of Ag or an alloy of Ag such as a Ag—Pd alloy or a Ag—Pt alloy, a Cu-based conductive material, a W-based conductive material, a Mo-based conductive material, or a Pd-based conductive material.

Thus, the filter of this embodiment comprises a plurality of resonators (the first resonator 20*a* and the second resonator 20*b*), the first terminal electrode 18*a*, and the second terminal electrode 18*b*. The first resonator 20*a* and the second resonator 20*b*) are each structurally identical with the resonator of the first embodiment. Moreover, the first resonator 20*a* and the second resonator 20*b* are disposed in an array so as to be electromagnetically coupled to each other. The first resonator 20*a* is located on one end of the array, and the second resonator 20*b* is located on the other end of the array. The first terminal electrode 18*a* is electrically or electromagnetically connected to the first resonator 20*a*, and the second terminal electrode 18*b* is electrically or electromagnetically connected to the second resonator 20*b*. The filter thus configured of this embodiment can be made compact, and has excellent characteristics involving little insertion loss in a pass band and high attenuation in the vicinity of the pass band.

Seventh Embodiment

Figure 14:
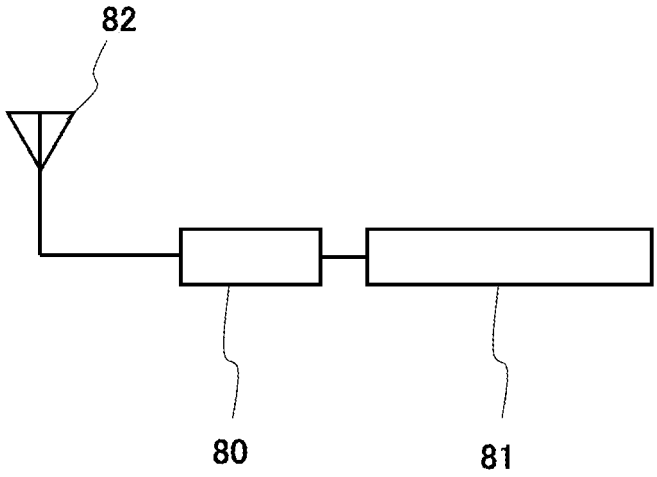
FIG. 14 is a block diagram schematically showing a communication device in accordance with a seventh embodiment of the invention.

FIG. 14 is a block diagram schematically showing a communication device in accordance with a seventh embodiment of the invention. The communication device of this embodiment comprises an antenna 82, a communication circuit 81, and a filter 80 connected to the antenna 82 and the communication circuit 81. The filter 80 is the filter of the foregoing sixth embodiment. The antenna 82 is a heretofore known conventional antenna, and the communication circuit 81 is also a heretofore known conventional communication circuit.

The communication device thus configured of this embodiment removes unnecessary electric signals by using the filter of the sixth embodiment that is compact and has excellent electrical characteristics. Accordingly, the communication device can be made compact and enables high-quality communication.

Modified Examples

It should be understood that the invention is not limited to the embodiments described hereinabove, and that various changes and modifications are possible based on the technical ideas of the invention.

For example, although the foregoing embodiments have been described with respect to the case where the columnar body 21 has a cylindrical shape, the invention is not limited to this. The columnar body 21 may be shaped in other form such as a quadrangular prism, a hexagonal prism, or an elliptical column. Moreover, as is the case with the resonator described in Patent Literature 1, the columnar body 21 may have a non-constant cross-sectional area.

Moreover, although the foregoing embodiments have been described with respect to the case where a single cylindrical first dielectric body 12 surrounds the columnar body 21, the invention is not limited to this. For example, the slits 15 shown in FIG. 5 may be formed so as to pass through the first dielectric body 12 in the positive z-direction to thereby divide the first dielectric body 12 into four pieces. That is, there are provided a plurality of first dielectric bodies 12 that are disposed so as to surround the columnar body 21.

Moreover, although the foregoing sixth embodiment has been described with respect to the case where the first resonator 20*a* and the second resonator 20*b* are each structurally identical with the resonator of the first embodiment, the invention is not limited to this. For example, the first and second resonators 20*a* and 20*b* may have either the same structure of the resonator of any one of the second to fifth embodiments or a different structure.

Moreover, although the foregoing sixth embodiment has been described with respect to the case where the filter comprises two resonators (the first resonator 20*a* and the second resonator 20*b*), the invention is not limited to this. The filter may comprise three or more resonators. In this case, an additional resonator or additional resonators may be placed between the first resonator 20*a* and the second resonator 20*b*, and all the resonators may be disposed in an array.

Moreover, although the foregoing seventh embodiment has been described with respect to the case where the filter 80 is the filter of the foregoing sixth embodiment, the invention is not limited to this. The filter 80 may be of another filter having similar features.

EXAMPLES

To begin with, the electrical characteristics of the resonator of the first embodiment shown in FIGS. 1 to 4 (the through hole 16 and the through hole 17 were omitted) have been determined by simulation. Conditions set for the simulation are as follows. The dielectric body constituting the first dielectric body 12 has a relative permittivity of 43 and a dielectric loss tangent of $2\times10^{-4}$. The first conductor 13, the second conductor 14, and the columnar body 21 have an electrical conductivity of $4.2\times10^{7}$ S/m. The cavity 19 measures 51 mm in a positive x-direction and a positive y-direction, and 39 mm in the positive z-direction. The columnar body 21 is 12 mm in diameter and 37 mm in length (dimension in the positive z-direction). The first dielectric body 12 is 16 mm in inside diameter, 18 mm in outside diameter, and 37 mm in length (dimension in the positive z-direction). The result of the simulation has showed that the resonant frequency of resonance in a fundamental mode is 757 MHz, the Q value of fundamental-mode resonance is 4611, and the resonant frequency of resonance in a higher-order mode with the lowest frequency is 3.47 GHz.

Next, the electrical characteristics of a resonator of comparative example (a typical quarter-wavelength semi-coaxial resonator) having a structure similar to the structure of the resonator shown in FIGS. 1 to 4 with the first dielectric body 12 removed (the through hole 16 and the through hole 17 were omitted) have been determined by simulation. In the resonator, an internal cavity (corresponding to the cavity 19 shown in FIGS. 1 to 4) of a shield case corresponding to the shield conductor 10 shown in FIGS. 1 to 4 measures 60 mm in the positive x-direction and the positive y-direction, and 44 mm in the positive z-direction. An internal conductor corresponding to the columnar body 21 shown in FIGS. 1 to 4 is constructed by joining a circular plate which is 25 mm in diameter and 2 mm in thickness (dimension in the positive z-direction) to an end in the positive z-direction of a cylinder which is 16 mm in diameter and 40 mm in length (dimension in the positive z-direction), and, an end in the negative z-direction of the cylinder is joined to the shield case for grounding. The physical properties of conductors constituting the shield case and the internal conductor are equal to those adopted in the foregoing simulation (the simulation performed on the resonator of the first embodiment). The result of the simulation has showed that the resonant frequency of resonance in a fundamental mode is 749 MHz, the Q value of fundamental-mode resonance is 4616, and the resonant frequency of resonance in a higher-order mode with the lowest frequency is 3.66 GHz.

The simulation results have proved that the resonator of the first embodiment is smaller in size than the resonator of the comparative example, yet affords excellent electrical characteristics equivalent to the electrical characteristics of the resonator of the comparative example.

Next, the electrical characteristics of the resonator of the third embodiment shown in FIGS. 6 to 9 (the through hole 16 and the through hole 17 were omitted) have been determined by simulation. Conditions set for the simulation are as follows. The dielectric body constituting each of the columnar body 21 and the first dielectric body 12 has a relative permittivity of 43 and a dielectric loss tangent of $1.6\times10^{-4}$. The first conductor 13 and the second conductor 14 have an electrical conductivity of $4.64\times10^{7}$ S/m. The cavity 19 measures 9.1 mm in the positive x-direction and the positive y-direction, and 8.2 mm in the positive z-direction. The columnar body 21 is 1.6 mm in diameter and 7.7 mm in length (dimension in the positive z-direction). The first dielectric body 12 is 2.6 mm in inside diameter, 5.6 mm in outside diameter, and 7.7 mm in length (dimension in the positive z-direction). The result of the simulation has showed that the resonant frequency of resonance in a fundamental mode is 5.91 GHz, the Q value of fundamental-mode resonance is 3530, and the resonant frequency of resonance in a higher-order mode with the lowest frequency is 7.49 GHz.

Next, the electrical characteristics of the resonator of the fourth embodiment having the four slits 15 shown in FIG. 10 have been determined by simulation. The slit 15 is 0.5 mm in width and 6.7 mm in length (dimension in the positive z-direction). Other conditions than those as to the four slits 15 to be fulfilled in this simulation are all the same as the conditions adopted in the foregoing simulation (the simulation performed on the resonator of the third embodiment). The result of the simulation has showed that the resonant frequency of resonance in a fundamental mode is 6.12 GHz, the Q value of fundamental-mode resonance is 3568, and the resonant frequency of resonance in a higher-order mode with the lowest frequency is 9.04 GHz.

The simulation results have proved that each of the resonator of the third embodiment and the resonator of the fourth embodiment features small size, yet affords excellent electrical characteristics involving a high Q in fundamental-mode resonance and an appreciable difference between the resonant frequency of resonance in a fundamental mode and the resonant frequency of resonance in a higher-order mode.

REFERENCE SIGNS LIST

10, 10*a*, 10*b*: Shield conductor
12, 12*a*, 12*b*: First dielectric body
13, 13*a*, 13*b*: First conductor
13*p*: Projection
14, 14*a*, 14*b*: Second conductor
15: Slit
16, 16*a*, 16*b*, 17, 17*a*, 17*b*: Through hole
18*a*: First terminal electrode
18*b*: Second terminal electrode
19, 19*a*, 19*b*: Cavity
20*a*: First resonator
20*b*: Second resonator
21, 21*a*, 21*b*: Columnar body
80: Filter
81: Communication circuit
82: Antenna

The invention claimed is:

1. A resonator, comprising:

a first shield conductor formed in a box shape having an opening;

a second shield conductor formed in a plate shape and covering the opening;

a first cavity formed between the first shield conductor and the second shield conductor;

a columnar body which is composed of a dielectric body or a conductor and has a columnar shape, the columnar body being placed inside the first cavity, one end of the columnar body being joined to the first shield conductor, an interval being provided between the other end of the columnar body and the second shield conductor; and at least one first dielectric body placed inside the first cavity, one end of the at least one first dielectric body being joined to the second shield conductor, an interval being provided between the other end of the at least one first dielectric body and the first shield conductor, the at least one first dielectric body surrounding the columnar body and being apart from the columnar body, a second cavity being formed between the at least one first dielectric body and the columnar body, wherein the at least one first dielectric body has a cylindrical shape, and the at least one first dielectric body is provided with a plurality of slits.

2. A resonator, comprising:

a first shield conductor formed in a box shape having an opening;

a second shield conductor formed in a plate shape and covering the opening;

a first cavity formed between the first shield conductor and the second shield conductor;

a columnar body which is composed of a dielectric body or a conductor and has a columnar shape, the columnar body being placed inside the first cavity, one end of the columnar body being joined to the first shield conductor, an interval being provided between the other end of the columnar body and the second shield conductor; and at least one first dielectric body placed inside the first cavity, one end of the at least one first dielectric body being joined to the second shield conductor, an interval being provided between the other end of the at least one first dielectric body and the first shield conductor, the at least one first dielectric body surrounding the columnar body and being apart from the columnar body, a second cavity being formed between the at least one first dielectric body and the columnar body, wherein the at least one first dielectric body comprises a plurality of first dielectric bodies which are disposed so as to surround the columnar body.

3. The resonator according to claim 1, wherein the columnar body is composed of a conductor.

4. A resonator, comprising:

a first shield conductor formed in a box shape having an opening;

a second shield conductor formed in a plate shape and covering the opening;

a first cavity formed between the first shield conductor and the second shield conductor;

a columnar body which is composed of a dielectric body or a conductor and has a columnar shape, the columnar body being placed inside the first cavity, one end of the columnar body being joined to the first shield conductor, an interval being provided between the other end of the columnar body and the second shield conductor; and at least one first dielectric body placed inside the first cavity, one end of the at least one first dielectric body being joined to the second shield conductor, an interval being provided between the other end of the at least one first dielectric body and the first shield conductor, the at least one first dielectric body surrounding the columnar body and being apart from the columnar body, a second cavity being formed between the at least one first dielectric body and the columnar body, wherein the columnar body is composed of a dielectric body.

5. The resonator according to claim 4, wherein the first shield conductor has a projection protruding toward the second shield conductor, an end of the projection is located, in a direction toward the second shield conductor, beyond a position of the other end of the at least one first dielectric body, and the one end of the columnar body is joined to the end of the projection.

6. A filter, comprising:

a plurality of resonators which are each structurally identical with the resonator according to claim 1, the plurality of resonators being disposed in an array so as to be electromagnetically coupled to each other, the plurality of resonators including a first resonator located at one end of the array and a second resonator located at the other end of the array;

a first terminal electrode electrically or electromagnetically connected to the first resonator; and a second terminal electrode electrically or electromagnetically connected to the second resonator.

7. A communication device, comprising:

an antenna;

a communication circuit; and the filter according to claim 6, the filter being connected to the antenna and the communication circuit.

8. The resonator according to claim 1, wherein the at least one first dielectric body separates the first cavity from the second cavity.

9. The resonator according to claim 2, wherein the at least one first dielectric body separates the first cavity from the second cavity.

10. The resonator according to claim 4, wherein the at least one first dielectric body separates the first cavity from the second cavity.

* * * * *